US009638141B2

(12) United States Patent
Barabasch et al.

(10) Patent No.: US 9,638,141 B2
(45) Date of Patent: May 2, 2017

(54) EXHAUST GAS VALVE DEVICE FOR AN INTERNAL COMBUSTION ENGINE

(71) Applicant: PIERBURG GMBH, Neuss (DE)

(72) Inventors: Guido Barabasch, Moenchengladbach (DE); Holger Paffrath, Pulheim (DE); Osman Sari, Grevenbroich (DE); Norbert Simons, Duesseldorf (DE); Rafael Soglowek, Duesseldorf (DE)

(73) Assignee: PIERBURG GMBH, Neuss (DE)

( * ) Notice: Subject to any disclaimer, the term of this patent is extended or adjusted under 35 U.S.C. 154(b) by 102 days.

(21) Appl. No.: 14/774,139

(22) PCT Filed: Feb. 14, 2014

(86) PCT No.: PCT/EP2014/052897
§ 371 (c)(1),
(2) Date: Sep. 10, 2015

(87) PCT Pub. No.: WO2014/139753
PCT Pub. Date: Sep. 18, 2014

(65) Prior Publication Data

US 2016/0025047 A1 Jan. 28, 2016

(30) Foreign Application Priority Data

Mar. 13, 2013 (DE) ..... 10 2013 102 549

(51) Int. Cl.
*F02M 26/54* (2016.01)
*F02M 26/73* (2016.01)
(Continued)

(52) U.S. Cl.
CPC ..... *F02M 25/0795* (2013.01); *F02M 26/54* (2016.02); *F02M 26/66* (2016.02); *F02M 26/73* (2016.02)

(58) Field of Classification Search
CPC ..... F02M 26/53; F02M 26/54; F02M 26/57; F02M 26/73; F02M 26/66; F02M 26/26;
(Continued)

(56) References Cited

U.S. PATENT DOCUMENTS 5,690,082 A 11/1997 Tanioka et al.
5,769,390 A 6/1998 Ando
(Continued)

FOREIGN PATENT DOCUMENTS

DE 196 24 901 A1 1/1997
DE 101 53 033 A1 5/2003
(Continued)

*Primary Examiner* — Hai Huynh
*Assistant Examiner* — George Jin
(74) *Attorney, Agent, or Firm* — Norman B. Thot

(57) ABSTRACT

An exhaust gas valve device for an internal combustion engine includes, an actor, an actor housing, a valve housing connected to the actor housing, an exhaust gas inlet, an exhaust gas outlet, a valve comprising a movement transmission member and a control body, and a coolant channel comprising a coolant inlet port and a coolant outlet port. The valve is configured to control a flow cross-section between the exhaust gas inlet and the exhaust gas outlet. The coolant channel is arranged to extend in the actor housing and in the valve housing. The coolant inlet port and the coolant outlet port are arranged on the actor housing.

13 Claims, 4 Drawing Sheets

(51) Int. Cl.
*F02M 25/07* (2006.01)
*F02M 26/66* (2016.01)

(58) Field of Classification Search
CPC ..... F02M 26/32; F02M 26/71; F02M 26/41; F02M 26/11; F02M 25/0795; F02M 25/0773; F02M 25/0788; F02M 2026/001; F01P 3/20; F01P 3/12
USPC ..... 123/568.12
See application file for complete search history.

(56) References Cited

U.S. PATENT DOCUMENTS

| | | | | |
|---|---|---|---|---|
| 6,216,677 | B1 * | 4/2001 | McConnell | F02M 26/67 123/568.12 |
| 2002/0174858 | A1 * | 11/2002 | Kato | F02B 47/08 123/568.12 |
| 2004/0099245 | A1 * | 5/2004 | Kato | F02M 26/22 123/434 |
| 2004/0107949 | A1 | 6/2004 | Miyoshi et al. | |
| 2007/0095334 | A1 | 5/2007 | Nanba et al. | |
| 2010/0263610 | A1 | 10/2010 | Mercz et al. | |
| 2014/0007852 | A1 * | 1/2014 | Huesges | F02M 26/51 123/568.12 |

FOREIGN PATENT DOCUMENTS

| | | | |
|---|---|---|---|
| DE | 103 44 218 | A1 | 4/2005 |
| EP | 0 763 655 | A2 | 3/1997 |
| EP | 2 357 350 | A1 | 8/2011 |
| JP | 7-233762 | A1 | 9/1995 |
| WO | WO 03/098026 | A1 | 11/2003 |

* cited by examiner

EXHAUST GAS VALVE DEVICE FOR AN INTERNAL COMBUSTION ENGINE

CROSS REFERENCE TO PRIOR APPLICATIONS

This application is a U.S. National Phase application under 35 U.S.C. §371 of International Application No. PCT/EP2014/052897, filed on Feb. 14, 2014 and which claims benefit to German Patent Application No. 10 2013 102 549.8, filed on Mar. 13, 2013. The International Application was published in German on Sep. 18, 2014 as WO 2014/139753 A1 under PCT Article 21(2).

FIELD

The present invention relates to an exhaust gas valve device for an internal combustion engine with an actor, an actor housing, a valve housing connected with the actor housing, an exhaust gas inlet, an exhaust gas outlet, a valve with a movement transmission member, a control body by which a flow cross-section between the exhaust gas inlet and the exhaust gas outlet can be regulated, and a coolant channel having a coolant inlet port and a coolant outlet port.

BACKGROUND

Valves used in the exhaust gas system, and in particular exhaust gas recirculation valves, serve to reduce exhaust gas emissions. Exhaust gas quantities adapted to the respective operating condition of the internal combustion engine are thereby recirculated into the cylinders of the internal combustion engine to reduce the pollutant constituents, in particular nitric oxides. The exhaust gas recirculation valves typically comprise an actor which is currently most frequently an electromotive actor that is most often operatively connected with a valve rod via a transmission, the valve rod being guided by a guide bushing in a housing of the valve and which has at least one control body at its end opposite the actor, which control body corresponds to a corresponding valve seat between an exhaust gas inlet and an exhaust gas outlet. Most exhaust gas recirculation valves are configured so that, in the closed state of the valve, the valve rod, as well as the transmission and the actor, are arranged in the area containing fresh air and are separated from the exhaust gas side by the control body. When the valve is opened, i.e., when the control body is lifted from the valve seat, hot exhaust gas flows towards the intake pipe so that so that the hot exhaust gas is in communication with the transmission housing. The thermal load on the actor thereby increases, which is the reason why exhaust gas valve devices have become known wherein a thermal separation of the housing, through which gas flows, from the actor is effected by a coolant channel via which heat is dissipated from the exhaust gas.

Such a valve is, for example, described in DE 103 44 218 A1. The valve described therein comprises a valve rod adapted to be actuated by an actor, the valve rod having a valve plate that controls a flow cross section. A coolant channel is formed in the flow housing radially around the valve rod, which channel is open to the actor housing and is closed by placing the actor housing thereon. The connecting nozzles are pressed into corresponding receptacles of the flow housing.

JP 07-233762 A further describes an exhaust gas recirculation valve which is adapted to be operated by a stepper motor, wherein the electric motor is surrounded by a coolant channel in the actor housing. The connecting nozzles for coolant supply are in this case also threaded or pressed into correspondingly formed holes.

These previously described exhaust gas recirculation valves generally either provide for heat dissipation from the actor, without, however, restricting the penetration of heat into the actor housing, or they provide for a mere thermal separation via the coolant channel so that heat once present in the actor cannot be sufficiently dissipated. An increased assembly effort also exists because the connection to the coolant circuit of the internal combustion engine must be effected via connecting nozzles that must be assembled separately because they cannot be realized in known cast housings.

SUMMARY

An aspect of the present invention is to avoid an excessive thermal load on the actor while providing a thermal shielding of the actor and a reliable heat dissipation from the actor without requiring an increased assembly effort.

In an embodiment, the present invention provides an exhaust gas valve device for an internal combustion engine which includes, an actor, an actor housing, a valve housing connected to the actor housing, an exhaust gas inlet, an exhaust gas outlet, a valve comprising a movement transmission member and a control body, and a coolant channel comprising a coolant inlet port and a coolant outlet port. The valve is configured to control a flow cross-section between the exhaust gas inlet and the exhaust gas outlet. The coolant channel is arranged to extend in the actor housing and in the valve housing. The coolant inlet port and the coolant outlet port are arranged on the actor housing.

BRIEF DESCRIPTION OF THE DRAWINGS

The present invention is described in greater detail below on the basis of embodiments and of the drawings in which.

DETAILED DESCRIPTION

Figure 1:
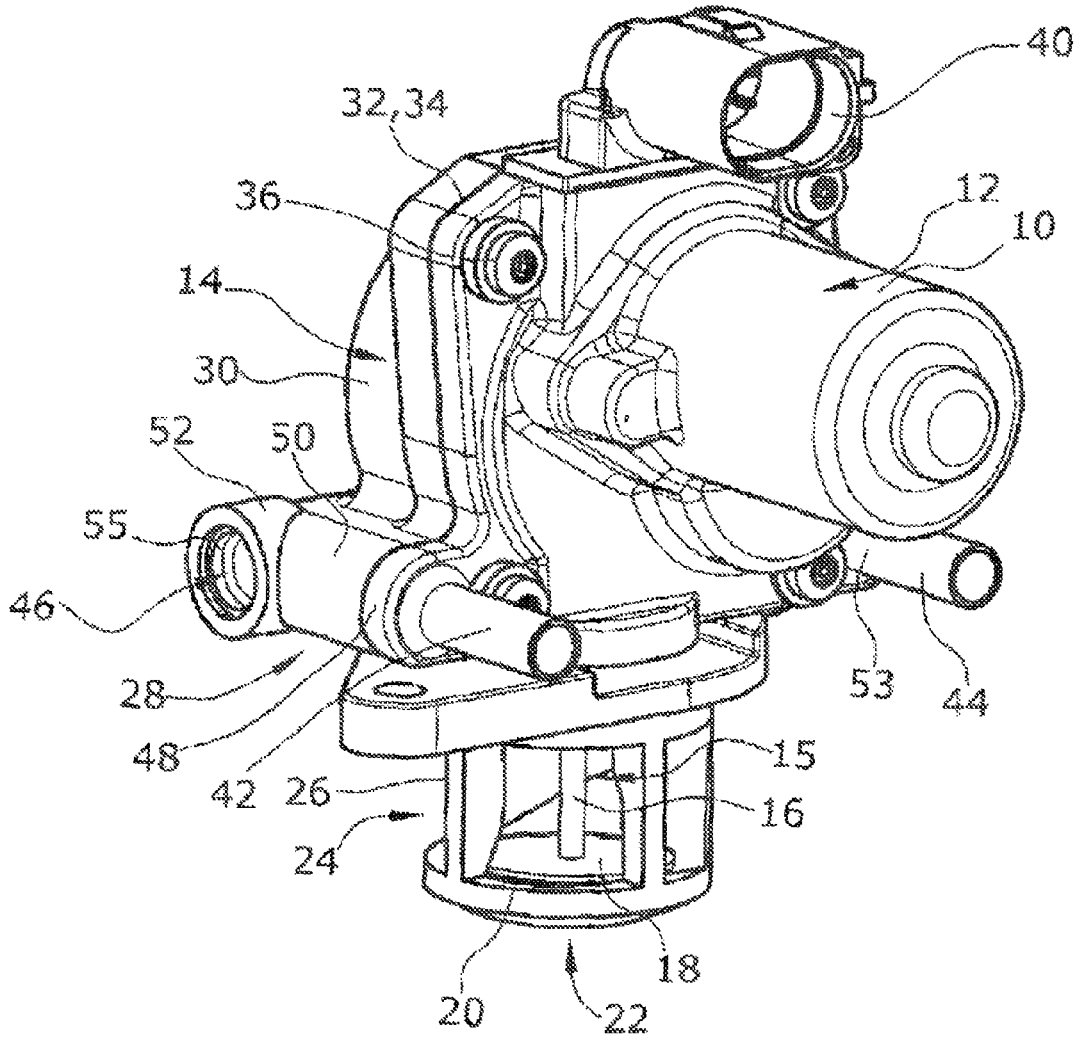
FIG. 1 shows a perspective side view of a first exhaust gas valve device according to the present invention.

Because the coolant channel extends in the actor housing and in the valve housing, with the coolant inlet port and the coolant outlet port being arranged on the actor housing, it is provided that heat is already removed from the exhaust gas before the heat reaches the actor, and that heat can also be dissipated directly from the actor housing. This requires no additional connections. A direct fluid communication exists between the coolant channel in the actor housing and the coolant channel in the valve housing, whereby additional conduits that would require mounting are not required.

In an embodiment of the present invention, the coolant inlet port and the coolant outlet port can, for example, be formed integrally with the actor housing. The assembly of the connecting nozzles can thus be omitted, which in known designs are threaded or pressed in and, in addition, must often first be coated with a sealing material.

In an embodiment of the present invention, the actor housing with the coolant inlet port and the coolant outlet port can, for example, be an injection molded plastic part. The actor housing can be made at low cost from a plastic material due to the good thermal shielding and heat dissipation.

In an embodiment of the present invention, the valve housing can, for example, have a flow housing portion in which the exhaust gas inlet and the exhaust gas outlet are formed, and a transmission housing portion in which a transmission connected to the actor is arranged. A precise adjustment of the exhaust gas valve is provided due to the use of a transmission. The division of the housing allows for a good sealing and shielding of the components which respectively differ in the tolerable thermal load and the sensitivity to dirt.

In an embodiment of the present invention, the actor housing can, for example, be fastened to the transmission housing portion so that a direct contact of the actor housing with the flow housing which is subjected to the highest thermal load is avoided.

In an embodiment of the present invention, the coolant channel can, for example, extend from the actor housing into the transmission housing portion and from the transmission housing portion to the actor housing. Heat is thus dissipated both from the transmission and from the actor. With a corresponding arrangement of this coolant channel, the actor housing, which is most heat sensitive, is thus shielded by the coolant channel in the transmission housing, while heat penetrating into or generated in the actor housing can still be dissipated. This results in a long useful life of the actor which is reliably protected from overheating.

A simple assembly and manufacture is achieved by forming the transmission housing portion and the flow housing portion as an integral cast part. A high thermal resilience of the valve housing is obtained by manufacturing the valve housing as a cast part.

In an embodiment of the present invention, the valve housing can, for example, have a flange surface at which the actor housing is fastened by its flange surface with interposition of a seal. This simplifies assembly and forms a sealed inner space closed to the outside to prevent ingress of dirt from outside.

In an embodiment of the present invention, the seal can, for example, radially surround an actor and transmission space at the flange surfaces and radially surround the coolant channel at one of the flange surfaces. Additional seals for the transition of the coolant channel from one housing portion to another can be omitted with such a design. This facilitates assembly and reduces manufacturing costs.

This seal is particularly easy to mount if it is arranged in an axial groove in the flange surface of the actor housing.

In an embodiment of the present invention, two pipe pieces can, for example, be formed integrally with the actor housing, which extend the coolant channel in the actor housing and protrude into the coolant channel in the transmission housing portion. Prior to being mounted, the actor housing can thus be pre-fixed in its position on the transmission housing, while a correct relative position of the coolant channels in the actor housing and in the transmission housing portion is provided.

In an embodiment of the present invention, the two pipe pieces can, for example, each be surrounded by a seal ring arranged in a radial groove, which is respectively formed in the coolant channel of the transmission housing portion. A reliable sealing of the coolant channel is thereby realized in a simple manner.

In an embodiment of the present invention, an actor in the form of an electric motor can, for example, be provided since it provides a high actuation accuracy.

An exhaust gas valve device is thus provided, in which, compared to previously-described designs, significantly improves the protection of the actor against excessive thermal loads, thereby allowing the use of an electric actor also in very high temperature ranges without the fear of overheating. The actor housing can accordingly be manufactured from plastic material. The assembly of such a valve device is particularly simple.

An embodiment of an exhaust gas valve device according to the present invention is illustrated in the drawings and will be described hereinafter.

Figure 3:
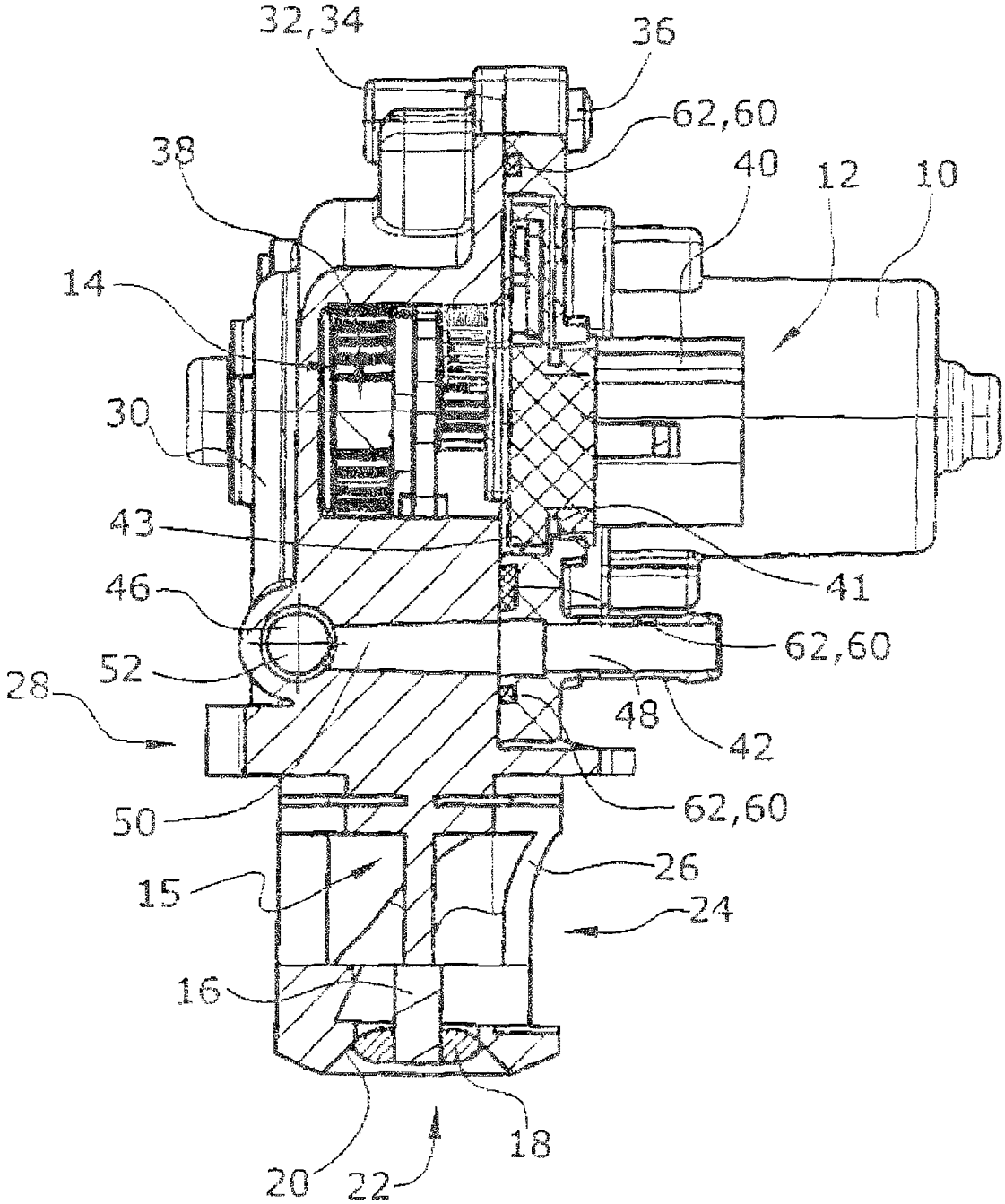
FIG. 3 shows a sectional side view of a second exhaust gas valve device according to the present invention.

The exhaust gas valve devices of the present invention illustrated in the drawings comprise an actor 12 arranged in an actor housing 10 and embodied as an electric motor 12 which drives a transmission 14 that is visible in part in FIG. 3. The transmission 14 is operatively connected with a valve 15 which comprises a movement transmission member 16 in the form of a valve rod 16 and a control body 18 in the form of a valve plate 18. In a manner known per se, the rotary movement of the electric motor 12 is converted into a translational movement of the valve rod 16 via the transmission 14, for example, via an eccentric/link connection. The valve plate 18 is mounted on the end of the valve rod 16 opposite the transmission 14 and cooperates with a valve seat 20 that surrounds a flow cross section between an exhaust gas inlet 22 and an exhaust gas outlet 24 so that, depending on the position of the valve plate 18, different quantities of exhaust gas can flow from the exhaust gas inlet 22 to the exhaust gas outlet 24 via the flow cross section.

The exhaust gas inlet 22 and the exhaust gas outlet 24, as well as the valve seat 20, are formed in a section of a valve housing 28 that serves as a flow housing portion 26. The valve housing 28, which in the present embodiment is made as an integral light metal die-cast part, further comprises a transmission housing portion 30 receiving the transmission 14. The valve rod 16 protrudes from the transmission housing portion 30 into the flow housing portion 26.

The transmission housing portion 30 comprises a flange surface 32 that contacts a flange surface 34 of the actor housing 10, and via which the actor housing 10 is fastened to the transmission housing portion 30 by screws 36. Inside the actor housing 10 and the transmission housing portion 30, an actor and transmission space 38 is formed correspondingly which is closed off to the outside.

For driving and controlling the actor 12, the actor housing 10 of both embodiments illustrated is equipped with a connector housing member 40 which, for assembly, is pushed beforehand into a corresponding opening 43 in the actor housing 10 from inside, with interposition of a connector seal 41. In the first embodiment, the connector seal 41 is mounted at the end of the actor housing 10 opposite the flow housing portion 26 and, in the second embodiment illustrated in FIGS. 3 and 4, it is arranged laterally with respect to the electric motor 12. Depending on the space available for the mounting of the exhaust gas valve device, the connector housing member 40 can be positioned in a correspondingly variable manner.

According to the present invention, the actor housing 10, designed as an injection molded plastic part, comprises two connecting nozzles formed as a coolant inlet port 42 and a coolant outlet port 44. These are formed integrally with the actor housing 10 and extend from the actor housing 10 in a direction opposite the transmission housing portion 30, and are arranged on both sides of the actor 12 in the region directed to the flow housing portion 26. The coolant inlet port 42 and the coolant outlet port 44 are in fluid communication via a coolant channel 46 which extends in part in the actor housing 10 and in part in the transmission housing portion 20.

The coolant channel 46 first extends through the actor housing 10 as an extension of the coolant inlet port 42 and into a second channel section 50 in the transmission housing portion 30, which second channel section 50 in turn linearly extends a first channel section 48. In the region averted from the actor housing 10, the coolant channel 46 is redirected vertically and ends in a third channel section 52. This third channel section 52 extends substantially along the width of the transmission housing portion 30 and is formed as a bore which is closed with a stopper 55 at the insertion end of the drill. At its other end, the third channel section 52 is again redirected by 90°, the bend being adjoined by a fourth, hidden channel section running parallel to the second channel section 50, while being formed on the opposite side of the transmission housing portion 30. This fourth channel section again ends linearly in a fifth channel section 53 which, correspondingly, is parallel to the first channel section 48 in the actor housing 10 and whose end is formed by the coolant outlet port 44. A coolant channel 46 extending on three sides is accordingly formed in the actor housing 10 and in the transmission housing portion 30 immediately above the flow housing portion 26, the coolant channel 46 correspondingly surrounding the movement transmission member 16 on three sides. This positioning of the coolant channel 46 provides that the actor 12 is thermally decoupled from the hot flow housing so that heat is dissipated by means of the coolant before it can reach the actor 12. Due to the arrangement of the first channel section 48 and the fifth channel section 53 in the actor housing 10, it is at the same time also possible to dissipate heat generated by the electric motor 12.

The integral structure of the coolant inlet port 42 and the coolant outlet port 44 significantly reduces the number of assembly steps otherwise required since no additional nozzles must be installed, i.e., pressed in or threaded in.

Figure 2:
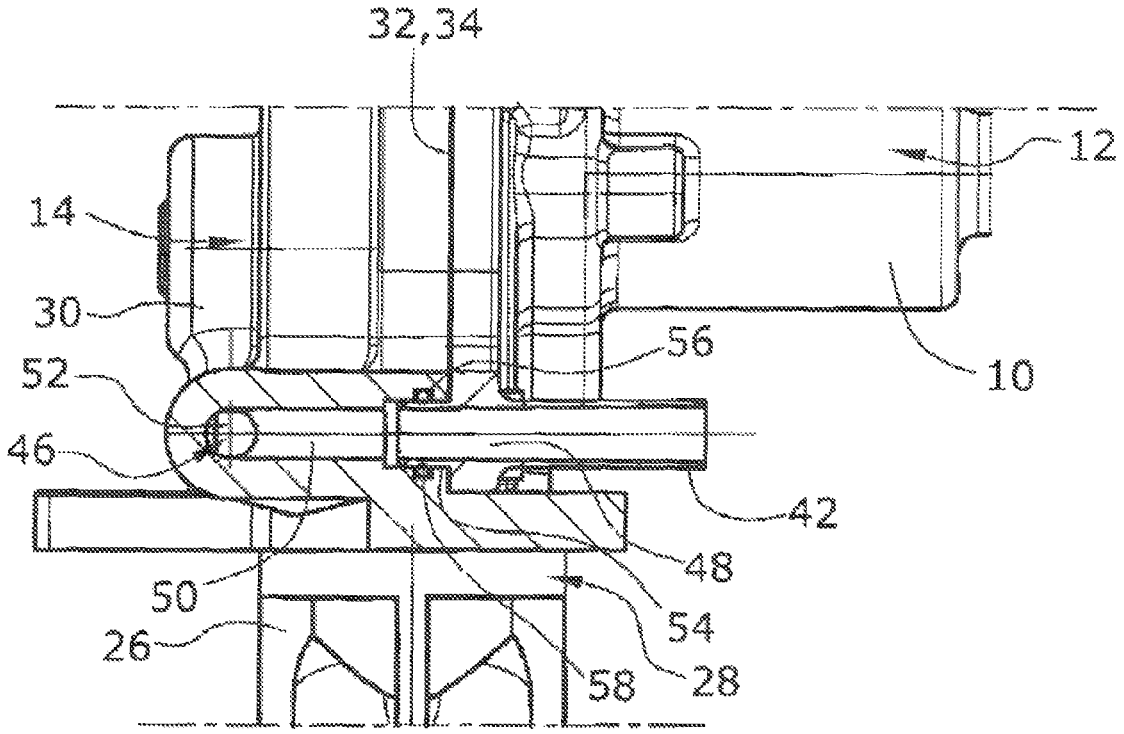
FIG. 2 shows a sectional side view of an enlarged detail of the exhaust gas valve device in FIG. 1.

In order to be able not only to obtain such a simple connection to a coolant circuit, but to also seal it, the embodiment in FIGS. 1 and 2 is provided with a pipe piece 54 formed on the actor housing 10 as an extension of the first channel section 48, the pipe piece 54 extending from the flange surface 34 of the actor housing 12 to the transmission housing portion 30. The pipe piece 54 protrudes into the second channel section 50 of the coolant channel 46 formed in the transmission housing portion 30, wherein, in this region, the inner diameter of the second channel section 50 substantially corresponds to the outer diameter of the pipe piece 54. In the second channel section 50, an annular radial groove 56 is formed in which a sealing ring 58 is arranged that radially surrounds the pipe piece 54. A sealed connection accordingly exists between the first channel section 48 in the actor housing 10 and the second channel section 50 in the transmission housing portion 30. The connection between the fourth channel section (not shown in the drawings) and the fifth channel section 53 is made and sealed in the same manner.

Figure 4:
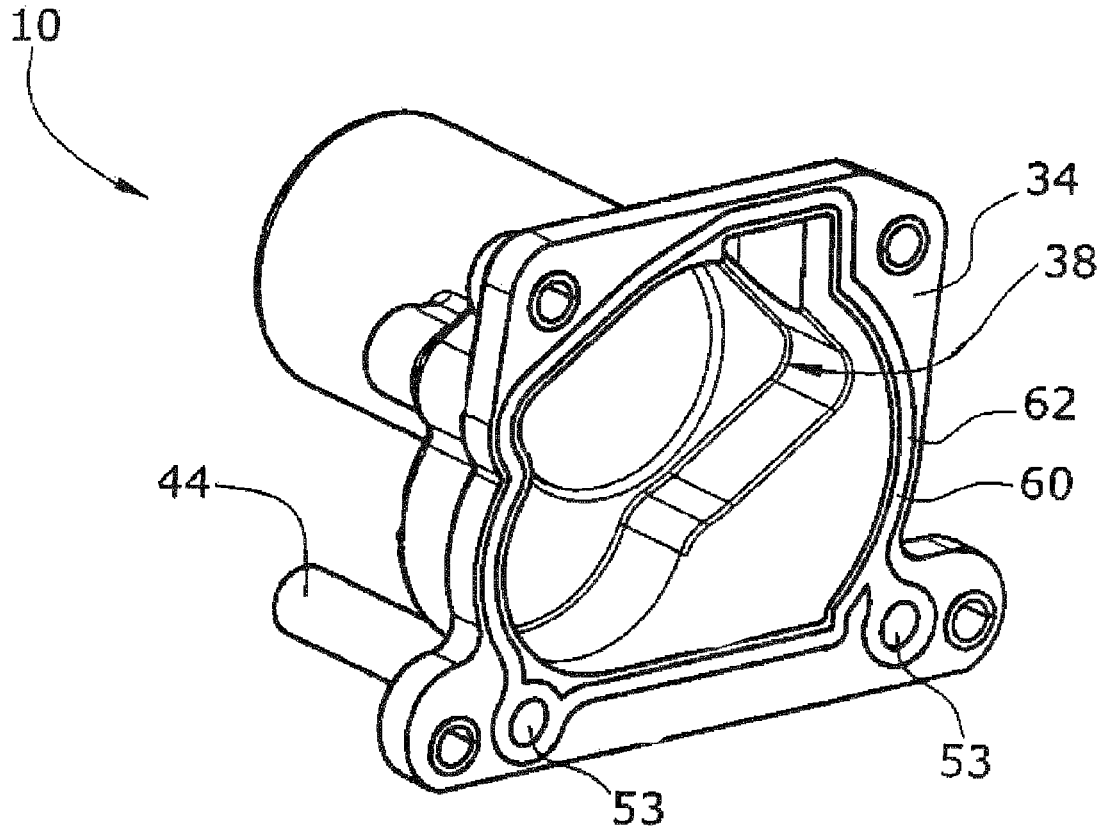
FIG. 4 shows a perspective view of an actor housing of the exhaust gas valve device illustrated in FIG. 3.

In the embodiment illustrated in FIGS. 3 and 4, the path of the coolant channel 46 is substantially the same, however, the sealing is obtained in a different manner. In this case, the pipe pieces 54 are omitted so that a substantially smooth flange surface 34 is formed which merely comprises an axial groove 60 in which a seal 62 is arranged. The axial groove 60 and the seal 62 are formed so that, on the one hand, the electric motor 12 with its control board, as well as a pinion driven by the electric motor (not shown in the drawings) which meshes with the adjoining transmission 14, are radially surrounded by the seal 62 in the region of the flange surface 34 and, on the other hand, the two ends of the first channel section 48 and the fifth channel section 53, which are directed to the transmission housing portion 30, are surrounded by the seal 62 so that in this case the sealing of the coolant channel 46 and the sealing of the actor and transmission space 38 is also achieved only with one seal 62. The region surrounding the ends of coolant channel 46 could of course also be sealed with a separate seal.

The screws 36 for connecting the actor housing 10 with the transmission housing portion 30, as well as the first channel sections 48 and the fifth channel section 53, are situated radially outside the seal 62 so that a leakage via the screw connections is also not to be feared.

Both embodiments therefore provide an excellent heat dissipation via the coolant channel 46, both from the actor housing 10 and from the transmission housing portion 30. Owing to the positioning of the coolant channel 46, a thermal shielding of the actor housing 10 from the flow housing portion 26 is also provided. The assembly effort, specifically for making the connection to the coolant circuit, is very low when compared to other designs, since the connecting nozzles and the actor housing 10 can be manufactured in one step.

The scope of protection of the present invention is not restricted to the embodiments described herein. The location and the positioning of the coolant channel can in particular be changed. An embodiment is, for example, conceivable which has a fully closed circuit of the coolant channel. The embodiment of the present invention is also suited for exhaust gas valve devices having a flap as a control body. A skilled person will also see other structural changes falling within the scope of protection of the present invention. Reference should also be had to the appended claims

What is claimed is:

1. An exhaust gas valve device for an internal combustion engine, the exhaust gas device comprising;

an actor;

an actor housing;

a valve housing connected to the actor housing;

an exhaust gas inlet;

an exhaust gas outlet;

a valve comprising a movement transmission member and a control body, the valve being configured to control a flow cross-section between the exhaust gas inlet and the exhaust gas outlet; and a coolant channel comprising a coolant inlet port and a coolant outlet port, the coolant channel being arranged to extend in the actor housing and in the valve housing, wherein, the coolant inlet port and the coolant outlet port are arranged on the actor housing.

2. The exhaust gas valve device as recited in claim 1, wherein the coolant inlet port and the coolant outlet port are formed integrally with the actor housing.

3. The exhaust gas valve device as recited in claim 2, wherein the actor housing comprising the coolant inlet port and the coolant outlet port is provided as an injection molded plastic part.

4. The exhaust gas valve device as recited in claim 1, further comprising a transmission connected with the actor, wherein, the valve housing comprises a flow housing portion in which the exhaust gas inlet and the exhaust gas outlet are formed, and a transmission housing portion in which the transmission is arranged.

5. The exhaust gas valve device as recited in claim 4, wherein the actor housing is fastened on the transmission housing portion.

6. The exhaust gas valve device as recited in claim 4, wherein the coolant channel is further arranged to extend from the actor housing into the transmission housing portion, and from the transmission housing portion to the actor housing.

7. The exhaust gas valve device as recited in claim 4, wherein the transmission housing portion and the flow housing portion are formed as an integral cast part.

8. The exhaust gas valve device as recited in claim 1, further comprising:

a seal, wherein, the actor housing comprises an actor housing flange surface, the valve housing comprises a valve housing flange surface, and the actor housing flange surface is fastened to the valve housing flange surface with the seal.

9. The exhaust gas valve device as recited in claim 8, further comprising:

an actor and transmission space arranged at valve housing flange surface and at the actor housing flange surface, wherein, the seal is arranged to radially surround the actor and transmission space at the actor and transmission space and at the actor housing flange surface, and to radially surround the coolant channel at the valve housing flange surface or at the actor housing flange surface.

10. The exhaust gas valve device as recited in claim 9, wherein the actor housing flange surface comprises an axial groove, and the seal is arranged in the axial groove.

11. The exhaust gas valve device as recited in claim 6, further comprising two pipe pieces which are formed integrally with the actor housing, the two pipe pieces being configured to extend the coolant channel in the actor housing and to protrude into the coolant channel in the transmission housing portion.

12. The exhaust gas valve device as recited in claim 11, further comprising:

a least one seal ring; and a radial groove formed in the coolant channel of the transmission housing portion, wherein, each of the two pipe pieces is surrounded by a seal ring, and each seal ring is arranged in the radial groove.

13. The exhaust gas valve device as recited in claim 1, wherein the actor is an electric motor.

* * * * *